US009316468B2

(12) United States Patent
Rall et al.

(10) Patent No.: US 9,316,468 B2
(45) Date of Patent: Apr. 19, 2016

(54) BULLET

(71) Applicant: SME ENGINEERING (PTY) LTD, Pretoria (ZA)

(72) Inventors: Adriaan Rall, Heilbron (ZA); Como Van Rooyen, Pretoria (ZA)

(73) Assignee: SME ENGINEERING (PTY) LTD, Pretoria (ZA)

( * ) Notice: Subject to any disclaimer, the term of this patent is extended or adjusted under 35 U.S.C. 154(b) by 0 days.

(21) Appl. No.: 14/077,827

(22) Filed: Nov. 12, 2013

(65) Prior Publication Data

US 2014/0318406 A1 Oct. 30, 2014

Related U.S. Application Data

(63) Continuation-in-part of application No. PCT/ZA2012/000093, filed on Dec. 5, 2012.

(30) Foreign Application Priority Data

Dec. 7, 2011 (ZA) ..... 2011/08972

(51) Int. Cl.
*F42B 12/34* (2006.01)
*F42B 33/00* (2006.01)

(52) U.S. Cl.
CPC ..... *F42B 12/34* (2013.01); *F42B 33/001* (2013.01)

(58) Field of Classification Search
CPC ..... F42B 12/34; F42B 14/02; F42B 33/001
USPC ..... 102/507, 508, 509, 510
See application file for complete search history.

(56) References Cited

U.S. PATENT DOCUMENTS

| | | | | |
|---|---|---|---|---|
| 3,910,194 | A * | 10/1975 | Dehm et al. | 102/527 |
| 4,665,827 | A * | 5/1987 | Ellis, II | 102/510 |
| 4,770,102 | A | 9/1988 | Bisping et al. | |
| 6,971,315 | B2 * | 12/2005 | Knappworst et al. | 102/510 |
| 7,299,750 | B2 | 11/2007 | Schikora et al. | |
| 7,966,937 | B1 * | 6/2011 | Jackson | 102/517 |
| 8,161,885 | B1 | 4/2012 | Emary | |
| 2005/0241523 | A1 | 11/2005 | Schikora et al. | |

FOREIGN PATENT DOCUMENTS

| | | | |
|---|---|---|---|
| DE | 38 22 775 | A1 * | 2/1990 |
| DE | 199 30 475 | A1 | 1/2001 |
| EP | 1 355 119 | A1 | 10/2003 |
| FR | 2846410 | * | 4/2004 |

OTHER PUBLICATIONS

International Search Report for corresponding International Patent Application No. PCT/ZA2012/000093 mailed May 28, 2013.

* cited by examiner

*Primary Examiner* — Stephen M Johnson
(74) *Attorney, Agent, or Firm* — Merchant & Gould P.C.

(57) ABSTRACT

The invention provides a bullet. The bullet comprises a bullet-shaped body of a first metal composition, which body has a hollow cavity defined therein along the axis of the bullet with an opening at the point of the bullet shaped body. The bullet further comprises a plunger of a second composition, preferably metal, which metal is harder than the first metal, and shaped generally complementary to the hollow cavity. Hollow empty cavities may preferably be provided between the plunger and the hollow.

9 Claims, 18 Drawing Sheets

BULLET

This application is a Continuation-in-Part of PCT/ZA2012/000093, filed 5 Dec. 2012, which claims benefit of Serial No. 2011/08972, filed 7 Dec. 2011 in South Africa and which applications are incorporated herein by reference. To the extent appropriate, a claim of priority is made to each of the above disclosed applications.

TECHNICAL FIELD OF THE INVENTION

This invention relates to bullets.

BACKGROUND TO THE INVENTION

From an external ballistics point of view, the inventors are aware that hunting bullets are designed for maximum penetration, maximum energy transfer and/or a combination thereof with minimum lead contamination and a lethal wound channel with minimum trauma to the surrounding tissue for optimized usage of meat. For maximum penetration the bullet normally comprises a single metal or alloy such as brass, lead or copper. The bullet point is usually rounded or flattened. Hunting bullets designed for maximum damage or energy transfer upon impact includes the soft point and hollow point expanding bullets.

Also of importance is the aerodynamic performance of a bullet. Typically a spitzer bullet with a boat tail design will have less drag than flat or hollow points with a flat tail. Often hollow point bullets are provided with a polymer point or filler to mimic the aerodynamic performance of a spitzer bullet. A hollow profiled tail can also capture the pressurised gas better and longer than a flat profiled tail, which increases the muzzle velocity.

Also of importance, from an internal ballistics point of view, is good seal between the bullet and the bore of barrel and engagement with the rifling of the barrel without excessive friction or drag, less bearing surface, enabling lower chamber pressures and higher bullet velocities.

The composition of a bullet depends on its purpose and typically for hunting it will be lead-core with copper jacket or a single metal or single alloy such as lead, copper or brass. Expanding hunting bullets normally comprise a lead-filled copper jacket with lead tip or mono-metal bullets, which may have a hollow point to provide expansion or the lead core is covered completely with copper known as a Full Metal Jacket bullet.

DISCUSSION OF THE PRIOR ART

U.S. Pat. No. 7,966,937 (Jackson) discloses a bullet body provided with a hollow and with side walls parallel to the side wall of the bullet body. A hard metal plunger is provided inside the cavity along a part of the cavity and the rest of the cavity is filled with a non-Newtonian fluid. A non-Newtonian fluid has flow properties different to that of Newtonian fluids such as air, gas, water etc. and a non-Newtonian fluid does not have a constant coefficient. Examples of a non-Newtonian fluid are some salt solutions and molten polymers. It is well known in the art that a hard metal plunger even if conical will fragment a bullet rather than expand a bullet upon impact. For this reason the art teaches using hollow points, deformable plastic fillers, non-Newtonian fillers etc. Jackson attempts to overcome the problem of fragmentation by using a non-Newtonian fluid to transmit forces from the plunger to the body via a non-Newtonian fluid and teaches specifically that other fluids are not ideal in Column 2 lines 20 to 45.

DE 199 30 475 (Dynamit) and other prior art discloses a bullet body having a conically shaped hollow, which hollow is filled with a soft "filler" material such as plastic. In some cases the plastic is merely added as a cap for ballistics purposes and in some cases such as in Dynamit, US2005/0241523, U.S. Pat. No. 6,971,315 and EP 1 355 119 it appears to also transmit a force to the bullet body to fragment such as for Dynamit and to fragment and expand in the other cases. In all cases the soft material deforms upon impact.

The tips of soft pointed spitzer type bullets in a magazine can also receive mechanical damage resulting from recoil. Mechanical damage to the tip of a bullet can negatively influence ballistics.

Dynamit and US2005/0241523 discloses a stepped (not conical in the case of Dynamit) shape of the hollow and the cavity between the shoulder of the step and the filler material is designed to specifically fragment the bullet instead of progressive and predictable expansion. In U.S. Pat. No. 6,971,315, the "pusher" of material softer than the bullet body is used to seal the opening of a hollow point for self-defense ammunition for aerodynamic "external ballistics" reasons and the shaft of the pusher which extends into a complimentary hollow is to press fit the pusher, See column 4 lines 56 to 60.

The inventors found that hollow point mono-metal bullets do not expand predictably and often fragmenting during impact and straying from the intended course resulting in poor weight retention, poor penetration in dense tissue and/or minimum to no expansion in non-dense tissue.

It is an objective of the invention to provide bullets which expands predictably and uniformly across the spectrum of impact velocities, irrespective of the type of tissue or impact velocity. It is also an object of the invention to provide a bullet which retains the bulk of its weight even at high impact velocities, therefore offering a good balance between penetration and tissue damage. It is a further objective of the invention to provide a bullet which does not fragment or fails prematurely during impact.

Further objective of the invention is to provide an environment friendly bullet product range that conforms to the worldwide need for an environmentally friendly, non-toxic and non-hazardous material choice.

GENERAL DESCRIPTION OF THE INVENTION

According to the invention there is provided a bullet which comprises:

a bullet-shaped body of a first metal composition, which body has a hollow cavity defined therein along the axis of the bullet with an opening at the point of the bullet shaped body;

a plunger of a second composition, which is harder than the first metal, and shaped generally complementary to the hollow cavity;

wherein the hollow cavity and the plunger have a generally complementary conical shape widening towards the point of the bullet; and wherein the plunger is dimensioned in such a way that when it is inserted into the hollow, the plunger will not reach the far end of the hollow to define an empty cavity.

The first metal composition may be of a softer, or the same composition as the second composition of the plunger. Preferably, however, the first metal composition is of a softer metal composition than the second composition, both preferable metal. Generally, the second metal should not deform in a plastic manner upon impact of the bullet. Some deformation can be expected. It will be appreciated that reference to metal composition includes a single metal composition such as copper or an alloy metal composition such as brass.

The inner surface of the hollow body may be generally conical or cylindrical or combinations thereof and provided with one or more shoulder formations, which taper outward towards the opening at the point of the bullet. It will be appreciated that the plunger's complementary conical shape or shoulder formation will bear against the complementary wall or shoulder formation of the inner surface of the hollow cavity's inner surface, forcing the body to expand as the plunger is forced into the hollow.

In addition, the plunger may be dimensioned in such a way that when it is inserted into the hollow, the plunger will not reach the far end of the hollow to define an empty cavity. It will be appreciated that this feature allows for the plunger to be inserted into the hollow past the rim of opening at the point of the bullet thereby exposing the rim to shear forces during penetration which further expands the bullet. In addition, air or any other gas or gas mixture, in the empty cavity will act as a shock absorber to prevent fragmentation of the body and the air will be compressed and released explosively to create a ram-jet effect to aid with wound channel formation and lowering friction to increase penetration.

Further, the shoulder formation of the plunger may not reach its complementary bearing formation on the inside surface of the hollow to also define a further circular empty cavity. In the case of a number of successive cavities, the volume of the cavities may decrease towards the point of the bullet. Again, progressively, air in the empty cavities will act as a shock absorber to prevent fragmentation of the body and the inventor believes that the air will be compressed and released explosively to create a ram jet effect to aid with wound channel formation and lowering friction to increase penetration.

The inventors believes that the mechanical forces, hydrodynamic drag and air compressed into and released from the cavities as the plunger is forced into the hollow forces the wall of the hollow body outward in a controlled, progressive and predictable rate. The escaping compressed air and resulting shock may also lower the friction and shearing forces of the bullet through tissue to increase weight retention while enlarging the wound channel and keeping a straight line reaching its intended target organs. The inventors also believe that the ram-jet like shock wave in front of the expanding bullet is maintained even after the plunger is discarded due to the remaining hollow profile of the leading point of the bullet. The plunger surface exposed to the impact can be made large relative to the exposed area of the body of the bullet itself so that expansion starts upon impact and since this area remains constant as it is not plastically deformable, the expansion continues in a controlled, progressive and predictable rate. The fact that the plunger can only be released from the body of the bullet after full expansion contributes with the controlled, progressive and predictable rate.

For some embodiments of the invention, such as heavy calibre bullets for big or dangerous game the exposed surface of the plunger may be flat and flush with the rim of the opening in the bullet body to define a typical flat nosed "meplat" bullet shape. For these embodiments of the invention, multiple cavities may be incorporated with the shoulder and bearing formation being at an angle of between 20 and 40 degrees of the axis, preferably 30 degrees.

For other embodiments of the invention, such as plains game bullets, which normally requires a "spitzer" or sharp point for increased aerodynamics, the plunger may be shaped to protrude past the rim of the opening in the bullet body and may continue and complete the shape of the bullet body into a typical spitzer bullet point. In this case the plunger will be exposed to impact before the bullet body to start the expansion process and add to the aerodynamics of the bullet. For these embodiments of the invention, at least one circular cavity may be defined between the plunger and a shoulder of the hollow and a further cavity at the end of the hollow is preferable. In a non-preferable embodiment one cavity may be defined at the end of the hollow with no cavity formed between the shoulder of the hollow and corresponding shoulder formation of the plunger, which is at an angle of between 10 and 20 degrees, which corresponds with the inner surface of the hollow.

The plunger may be from a brass-alloy and the bullet body may be copper in a half-hard condition. The copper bullet body may be annealed. It will be appreciated that any metal of suitable density and hardness may be used respectively for the plunger and bullet body. It is preferable that the plunger is of a harder metal than the bullet body.

The invention also includes the use of three or more axially spaced cannelure bands, which extends radially past the bore diameter of the bullet to engage and fill the rifling grooves of a rifle barrel to form a good gas seal in a similar manner to piston rings in a sleeve. The cannelure grooves between the bands also have the bore diameter of the bullet. Since it is not the whole surface of the bullet which engages with the rifling grooves, friction is minimised when the bullet is forced out of the barrel of a rifle or gun i.e. less bearing surface. In addition the rim of a cartridge neck is crimped into any suitable cannelure groove, giving various options to set the bullet deeper or shallower in the cartridge, optimizing bullet jump and provide the re-loader with more flexibility.

The leading edge of the cannelure band may be angled at between 9 to 13 degrees of the axis and the trailing edge of the band may be perpendicular to the axis. It will be appreciated the perpendicular edge will prevent a bullet from being forced deeper in the cartridge after being crimped, while the angled leading edge will improve aerodynamics, lower friction inside the barrel, and prevent brass case shear. In addition, the inventor found that the perpendicular trailing edge, which may also be undercut instead of perpendicular, of the first forward cannelure band creates a low pressure zone for the rest of the bands and bullet body, which lowers friction and improves aerodynamics known as external ballistics.

It will be appreciated that the bullet includes virtually zero lead and is therefore environmentally friendly.

The invention also extends to a method for making a bullet, which method includes the steps of:

forming a bullet body as described above; and inserting a plunger, as described above, into the hollow defined in the hollow bullet body.

The bullet body may preferably be formed on a CNC lathe.

The invention also extends to a bullet shaped body of a first metal composition, which body:

has a hollow cavity defined therein along the axis of the bullet with an opening at the point of the bullet shaped body; and which is configured to receive a plunger of a second metal composition and which plunger is shaped generally complementary to the hollow cavity.

The invention also extends to a plunger, which plunger:

is configured to be received, substantially complementary, within a bullet shaped body substantially as described above.

Although opposite to the teachings of the prior art, according to the current invention, the complimentary conical shape of the hollow and hard plunger together with the hollow cavity causes the bullet to expand in a controlled and predictable manner, as explained in the body of the specification on page 3 lines 25 to 35. In addition to shock absorption to prevent fragmentation, the air in the cavity is compressed and released explosively to give advantageous pneumatic effects during the cause of a wound channel. The explosive and symmetrical release of air from the hollow cavity that a ram jet (air shield) effect is created, which protects the bullet to give good weight retention, increases the wound channel diameter, resists deflection and fragmentation, and lowers friction for good penetration. In addition, it appears that the release of air also lowers the friction between the plunger and the hollow cavity again promoting predictable expansion and increases penetration.

In the prior art, where a hollow in a bullet is filled with a soft "filler" material the soft filler material deforms upon impact unlike the hard metal plunger of the current invention. The area upon which the plunger, in accordance with the invention, receives a pushing force remains constant unlike the soft material which deforms. This area is large compared to the rest of the front end of the bullet to ensure expansion irrespective of the type of tissue through which the bullet travels. Since the plunger is of hard material and complementary to the hollow it stays in the hollow to function until the bullet is fully expanded. The prior art does not teach or suggest the use of a plunger of a metal harder than the body of the bullet to provide a bullet with predictable and progressive expansion while minimising fragmentation.

It is also well known that a dense metal such as lead is used in most bullets especially copper jacketed lead bullets and that hollow bullets require lead to compensate to keep the same volume compared to an equivalent solid copper bullet. The using of a further metal as a plunger instead of a plastics material, such as in the current invention, helps retain a higher weight to volume ratio for the bullet, this is an advantage over the prior art since this allows elimination of the use of lead with its negative environmental impact and to have expansion bullets and non-expansion mono metal known as "solids" with similar weight and ballistics. For example, for dangerous game hunting, a hunter can use a non lead containing expanding bullet, in accordance with the invention, followed by a non lead containing solid bullet in case of a charge with very similar ballistics.

The hard metal plunger of the current invention resists mechanical damage to the tips of spitzer type bullets.

In addition, hollow point bullets, even with a deformable filler or "pusher" as described in the prior art often does not expand when impacting soft tissue or predominantly water containing tissue such as intestines. The hard metal plunger of current invention forces expansion irrespective of the type of tissue which is impacted.

Since prior art such as Dynamit and US2005/0241523 teaches the use of a softer material than that of the bullet body, the release of high pressure air to cause advantageous pneumatic effects during the cause of a wound channel is not possible and not suggested or taught. This is particularly important in the case of successive and progressive cavities, in accordance with a further aspect of this invention.

DETAILED DESCRIPTION OF THE INVENTION

The invention is now described by way of examples with reference to the accompanying drawings.

Figure 1:
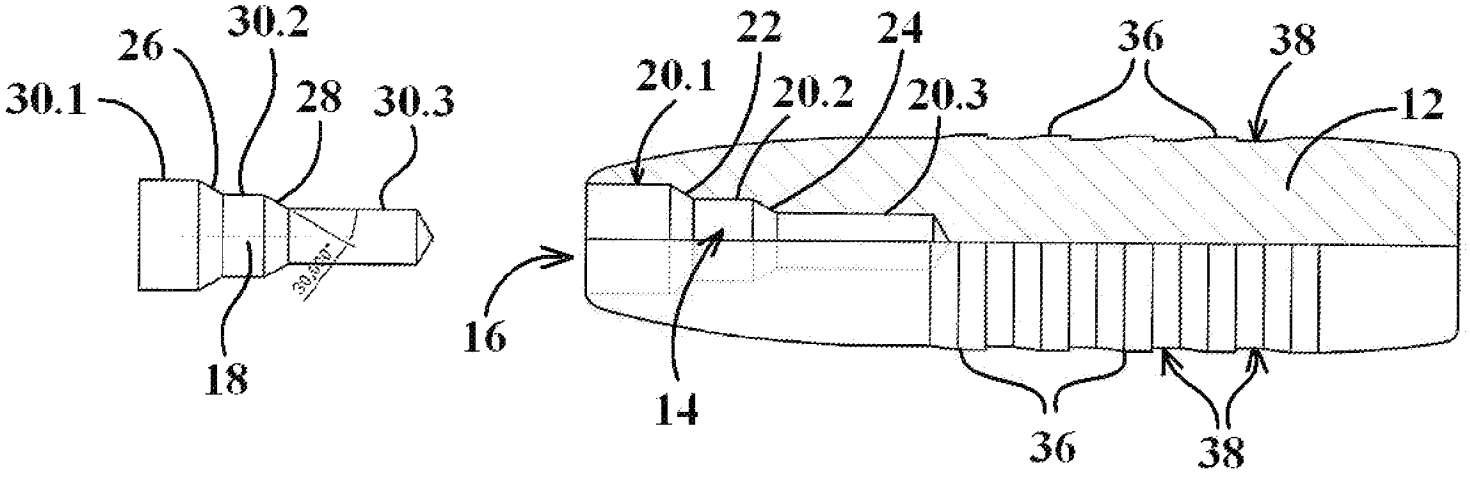
FIG. 1 shows a partial cross-sectional side view of a "meplat" type bullet, in accordance with the invention, before the plunger is fitted inside the bullet body.

Referring now to the drawings, the bullet, in accordance with the invention, is generally indicated by reference numeral 10.

The bullet 10, which is boat tailed, comprises a bullet shaped body 12 of copper alloy, which body has a hollow 14 defined therein along the axis of the bullet with an opening 16 at the point of the bullet shaped body. The bullet further includes a plunger 18 of a brass composition and generally shaped complementary to the hollow.

The body 12 may be of copper in a half-hard, annealed condition.

Figure 2:
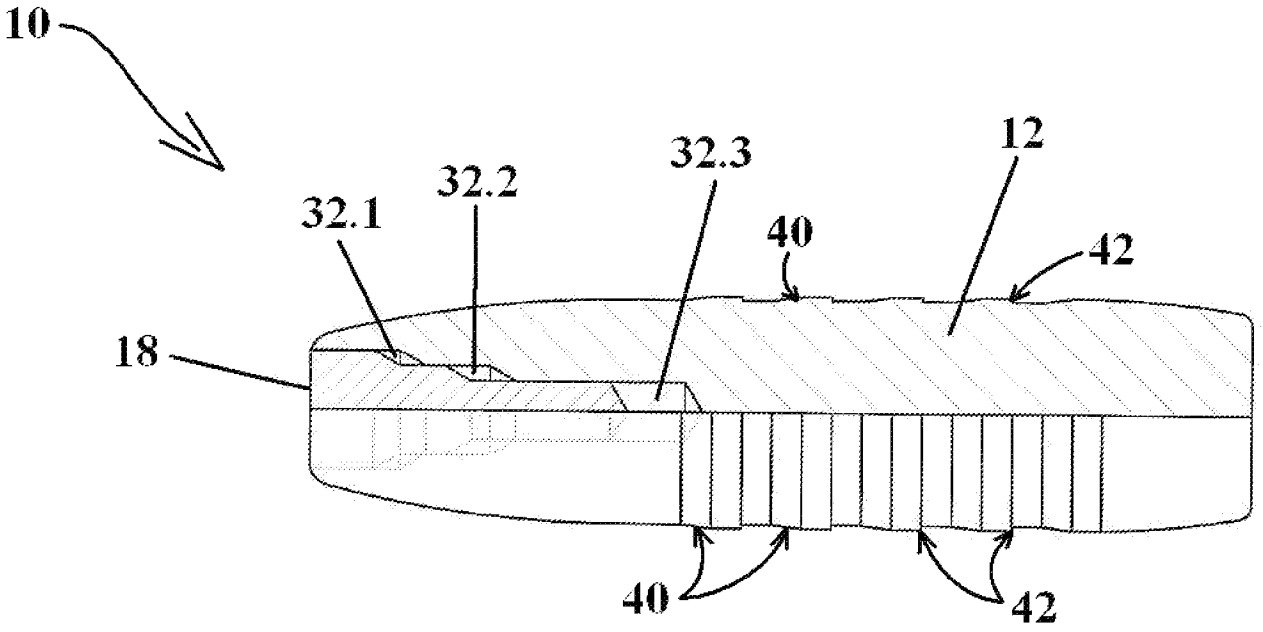
FIG. 2 shows a partial cross-sectional side view of the bullet, in accordance with the invention, after the plunger is fitted inside the bullet body.
Figure 3:
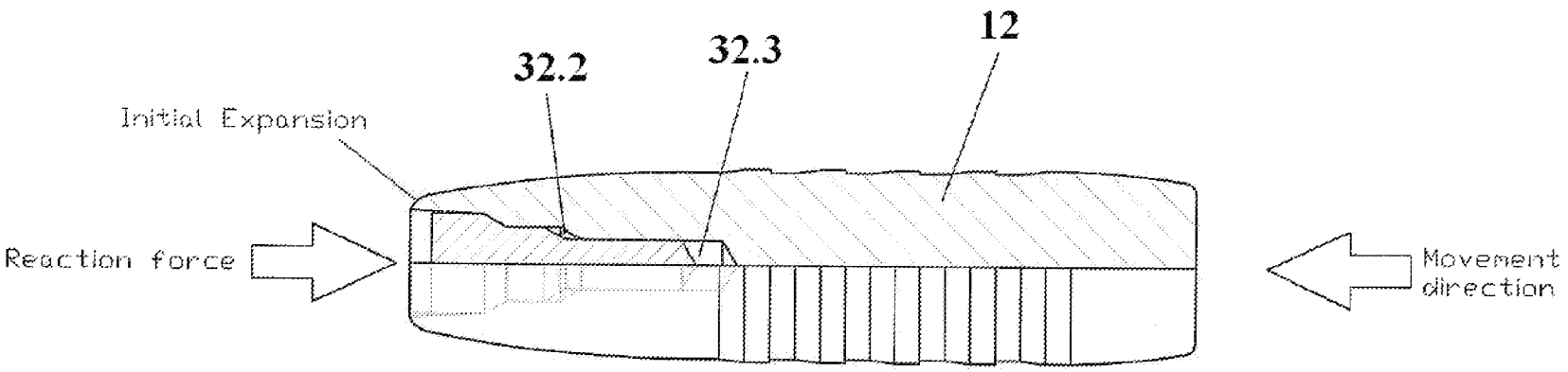
FIGS. 3 to 7 shows the progressive expansion of the bullet, in accordance with the invention.
Figure 4:
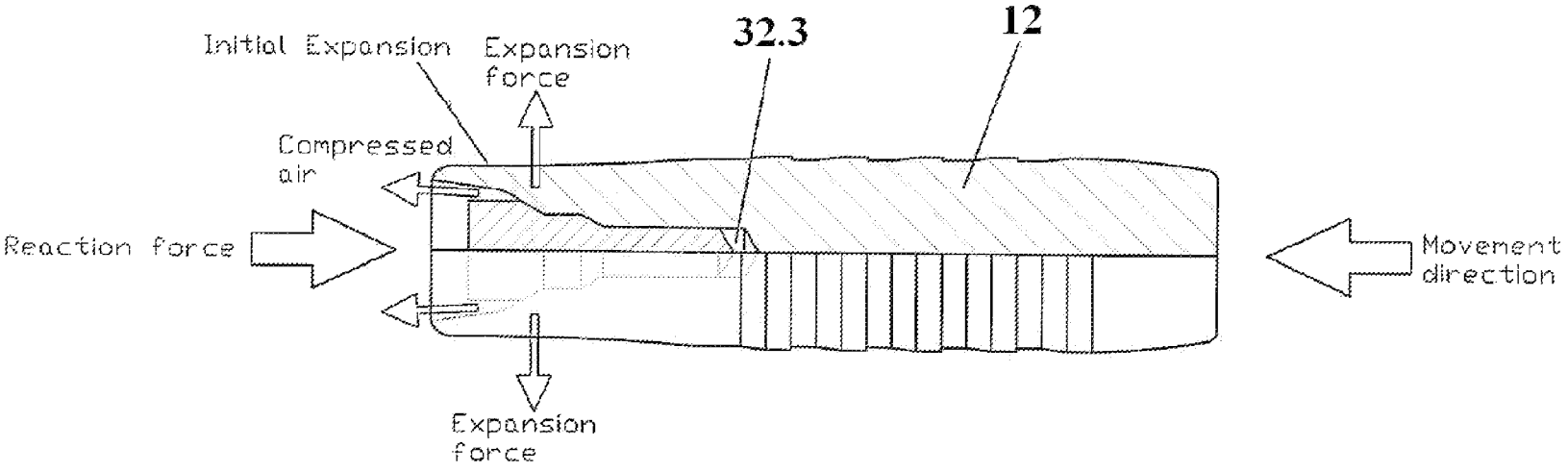
Figure 5:
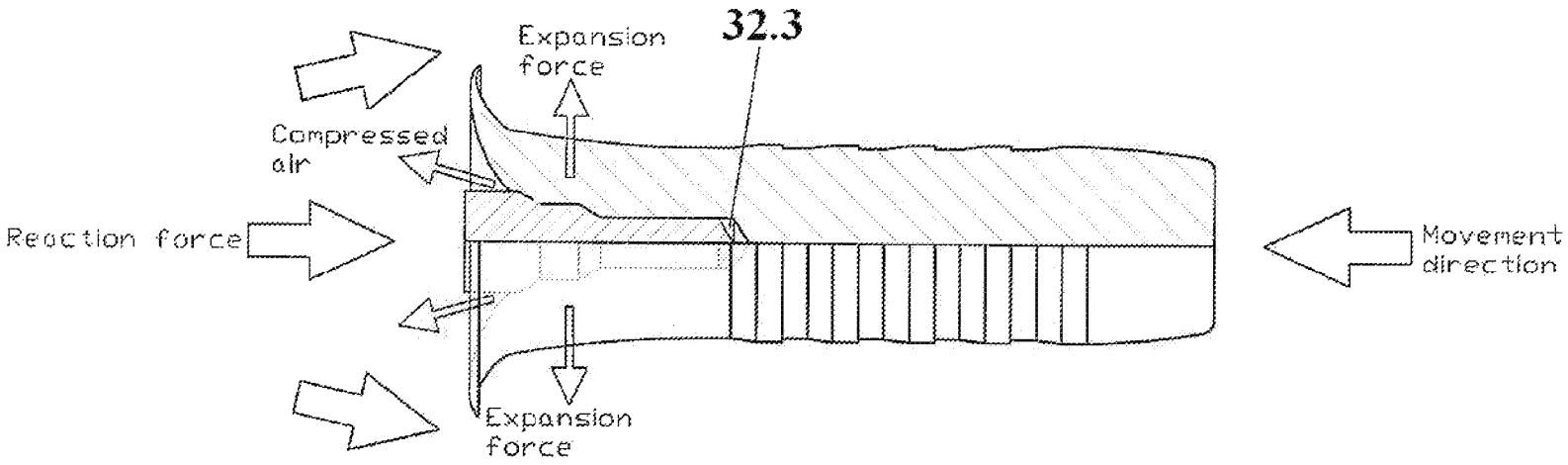
Figure 6:
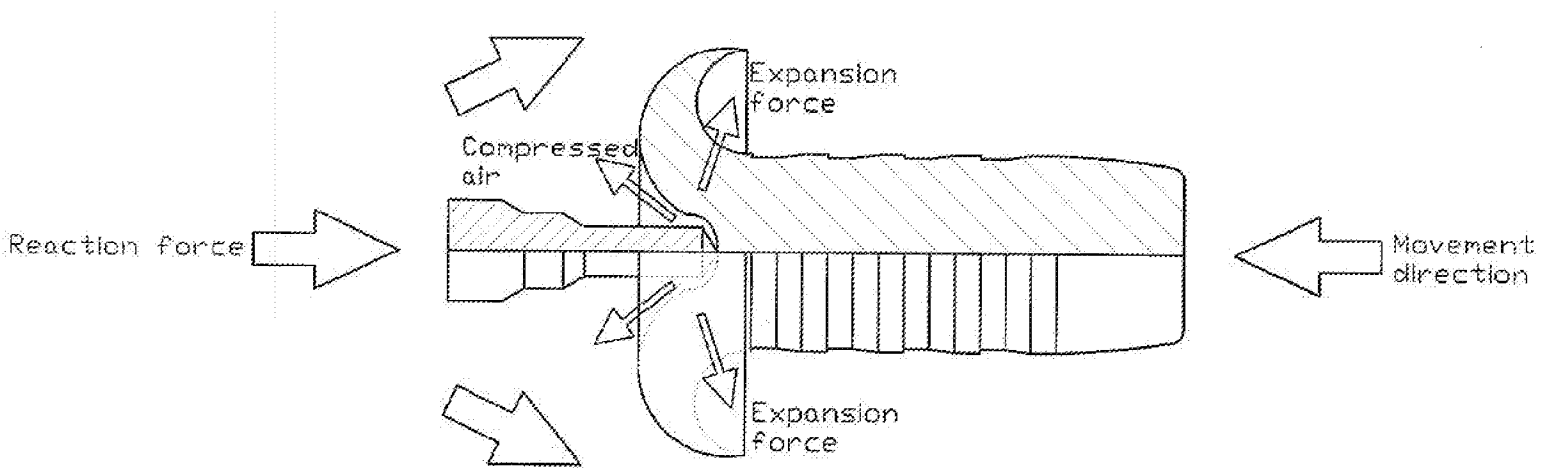
Figure 7:
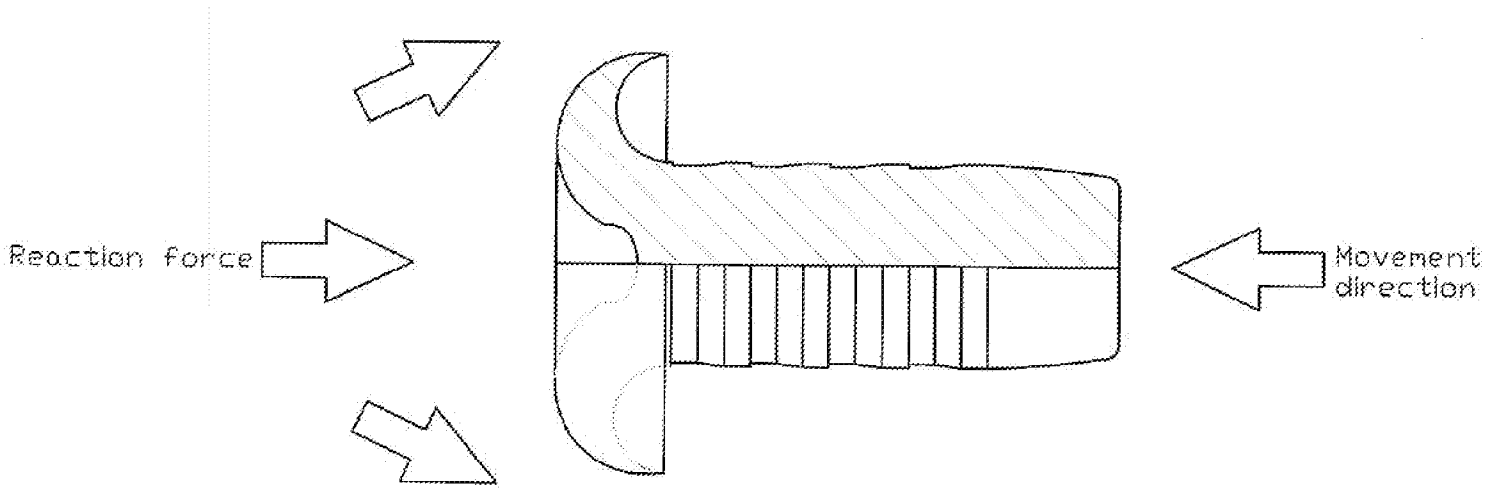

In a first example, FIGS. 1 to 7, the inner surface of the hollow body may be a combination of three cylindrical bores 20 the widest bore 20.1 leading to the opening 16 followed by a second 20.2 and third bore 20.3, each being narrower than the previous bore. Between the first bore 20.1 and the second bore 20.2 is a tapered shoulder formation 22. Between the second bore 20.2 and third bore 20.3 is another tapered shoulder formation 24. The shoulder formations 22 and 24 taper outward towards the opening at an angle of 30 degrees. The plunger has corresponding shoulder formations 26 and 28.

In addition, the plunger 18 is dimensioned such that its cylindrical portions 30.1, 30.2, and 30.3 is progressively shorter than its corresponding bore 20.1, 20.2 and 20.3 to define progressively larger cavities 32.1, 32.2 and 32.3 when the plunger 18 is inserted into the hollow. The plunger 18 may be flat and flush with the rim of the opening 16 in the bullet body 12 to define a typical flat nosed "meplat" bullet shape.

As shown in FIGS. 3 to 7, the combined mechanical forces and air compressed into and released from the cavities as the plunger 18 is forced into the hollow 14 forces the wall of the hollow body 12 outward in a controlled, progressive and predictable rate. The escaping compressed air and resulting hydrostatic shock also lowers the friction and shearing forces of the bullet through tissue to increase weight retention while enlarging the wound channel and keeping its straight line rigidity towards its intended target.

In a second example of the invention, such as plains game bullets, which is provided with a "spitzer" or sharp point for increased aerodynamics, the plunger 18 is shaped to protrude past the rim of the opening 16 in the bullet body 12 and continues and completes the shape of the bullet body into a typical spitzer bullet point. In this case the plunger 18 is exposed to impact before the bullet body to start the expansion process and adds to the aerodynamics of the bullet. In this example, only one cavity 32 is formed at the end of the hollow 14. The shoulder 26 and corresponding shoulder formation 34 of the plunger 18 which is at an angle of 13.5 degrees.

Figure 8:
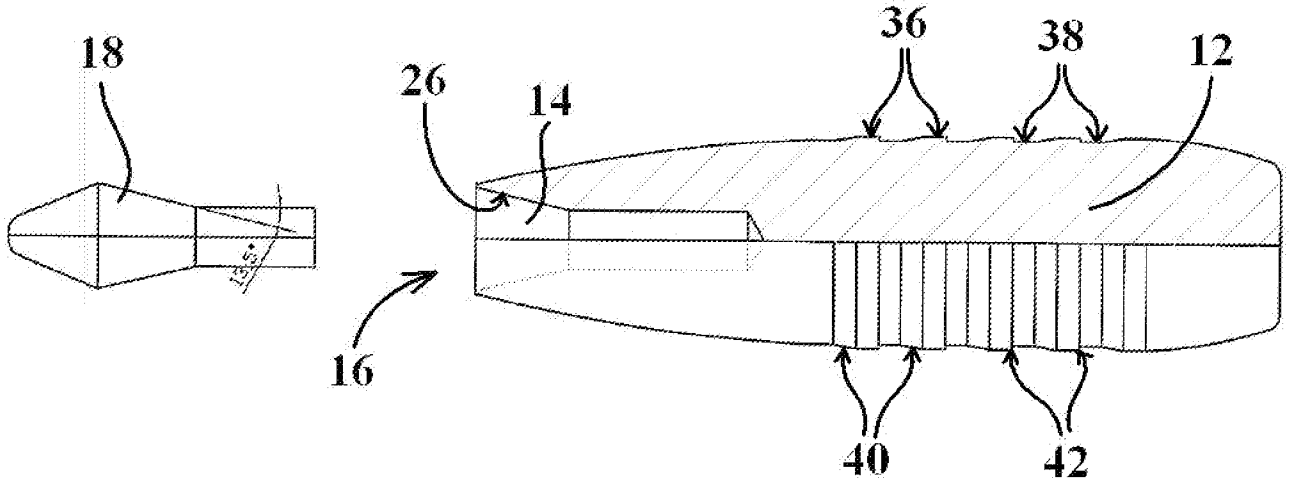
FIG. 8 shows a partial cross-sectional side view of another embodiment, a "spitzer" type, of the invention, in accordance with the invention, before the plunger is fitted inside the bullet body.
Figure 9:
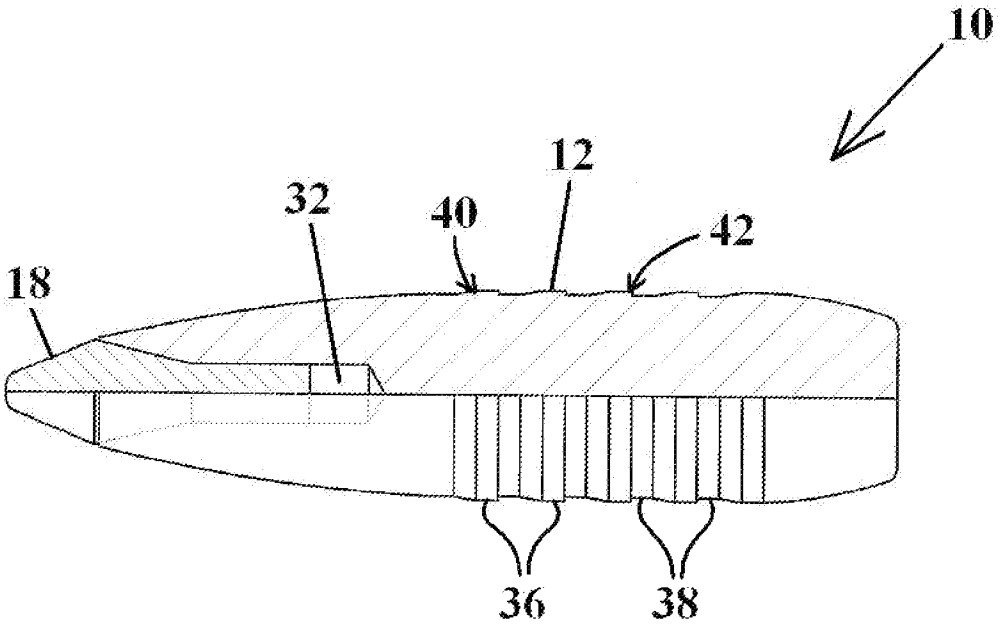
FIG. 9 shows a partial cross-sectional side view of the bullet, in accordance with the invention, after the plunger is fitted inside the bullet body.
Figure 10:
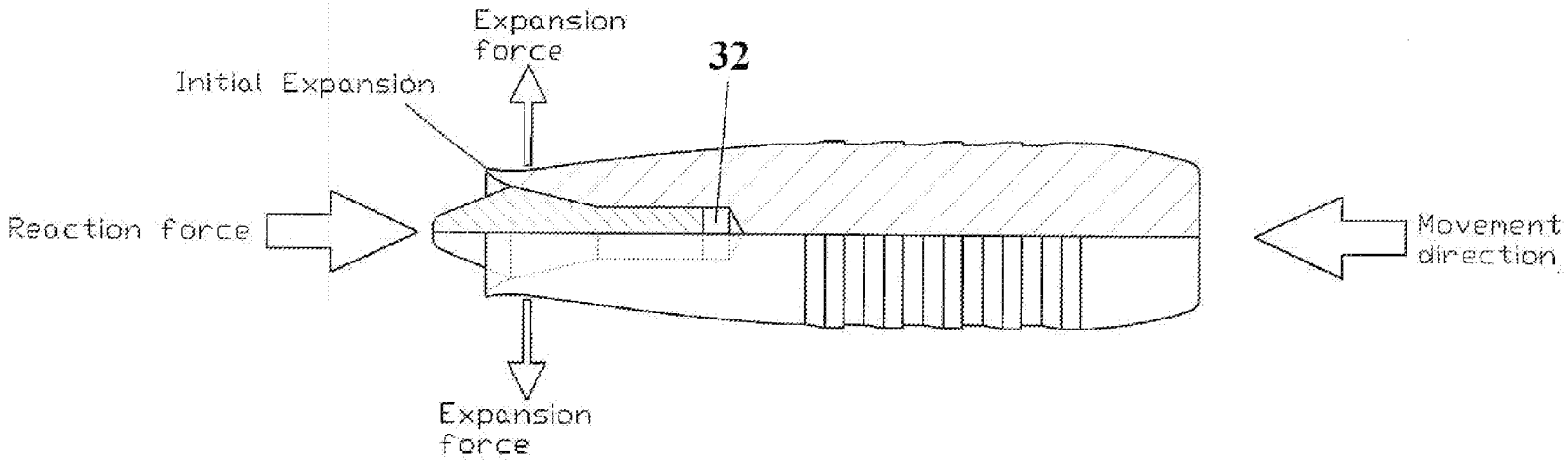
FIGS. 10 to 12 shows the progressive expansion of the bullet, in accordance with the invention.
Figure 11:
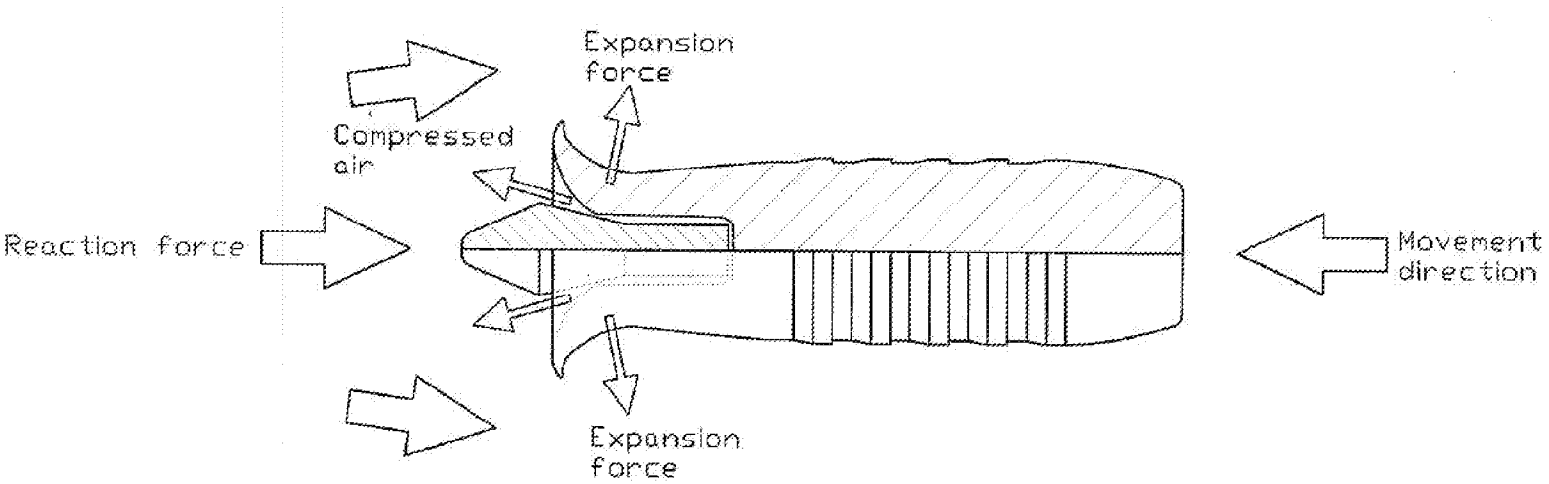
Figure 12:
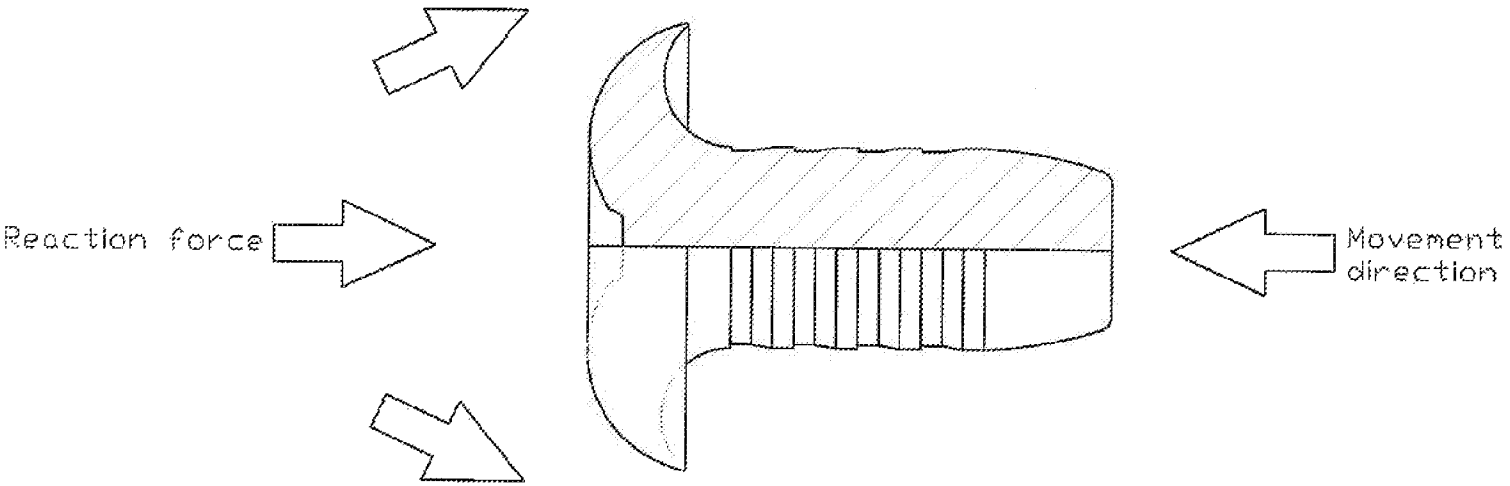

As shown in FIGS. 8 to 12, the combined mechanical forces and air compressed into and released from the cavity 32 as the plunger 18 is forced into the hollow 14 forces the wall of the hollow body 12 outward in a controlled, progressive and predictable rate. The escaping compressed air and resulting hydrostatic shock also lowers the friction and shearing forces of the bullet through tissue to increase weight retention while enlarging the wound channel and keeping its straight line rigidity towards its intended target.

In a third example of the invention, a preferred example of a plains game bullet, which is also provided with a "spitzer" or sharp point for increased aerodynamics, the plunger 18 is shaped to protrude past the rim of the opening 16 in the bullet body 12 and continues and completes the shape of the bullet body into a typical spitzer bullet point. In this case the plunger 18 is exposed to impact before the bullet body to start the expansion process and adds to the aerodynamics of the bullet. In this example, a first circular cavity 31 is defined between the conically shaped part of the plunger 18 and a cylindrically shaped part 26 of the hollow 14 and a second cavity 32 is formed at the end of the hollow 14. The shoulder formation 34 of the plunger 18 is at an angle of 66.6 degrees while the corresponding shoulder 37 is at an angle of 121 degrees.

Figure 13:
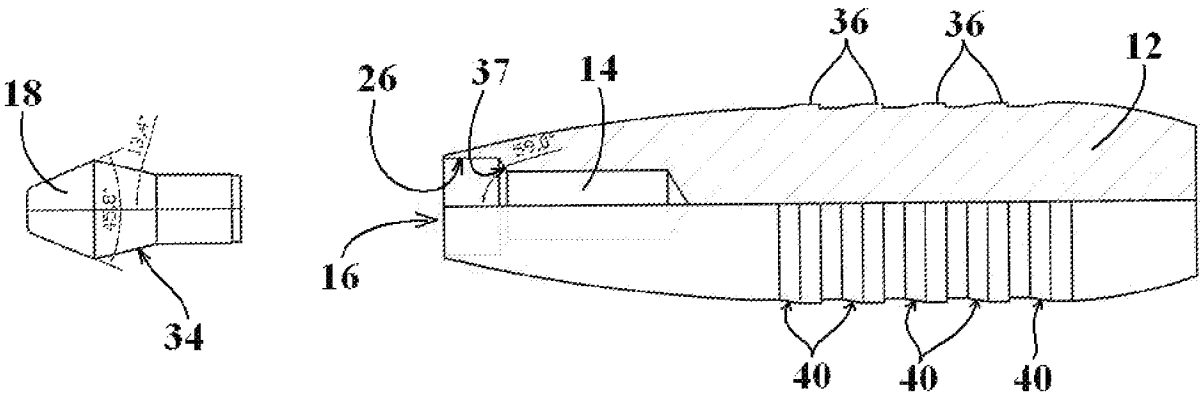
FIG. 13 shows a partial cross-sectional side view of a preferred "spitzer" embodiment of the invention, in accordance with the invention, before the plunger is fitted inside the bullet body.
Figure 14:
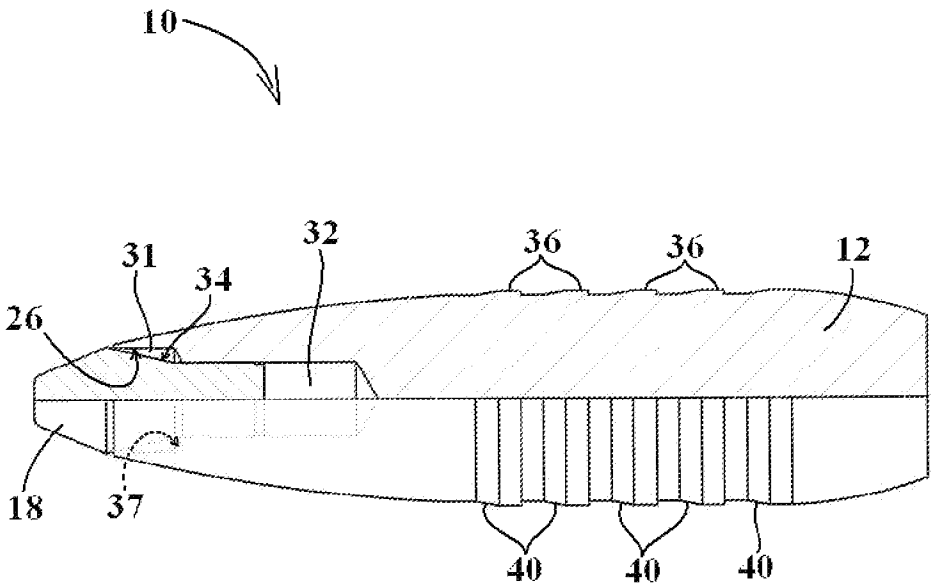
FIG. 14 shows a partial cross-sectional side view of the bullet, in accordance with the invention, after the plunger is fitted inside the bullet body.
Figure 15:
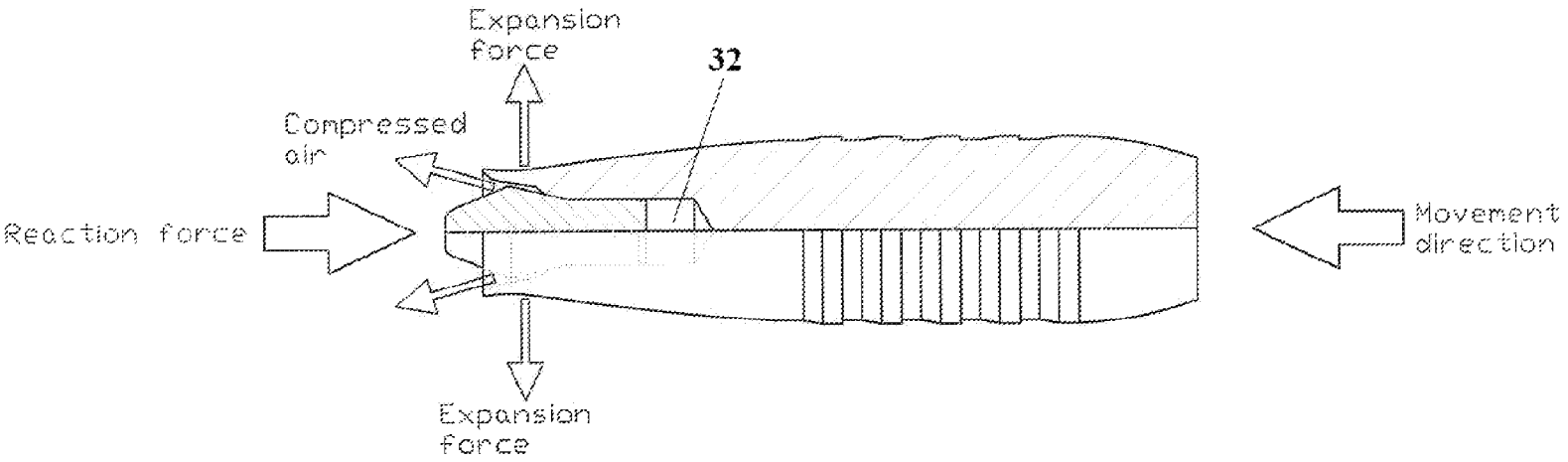
FIGS. 15 to 17 shows the progressive expansion of the bullet, in accordance with the invention.
Figure 16:
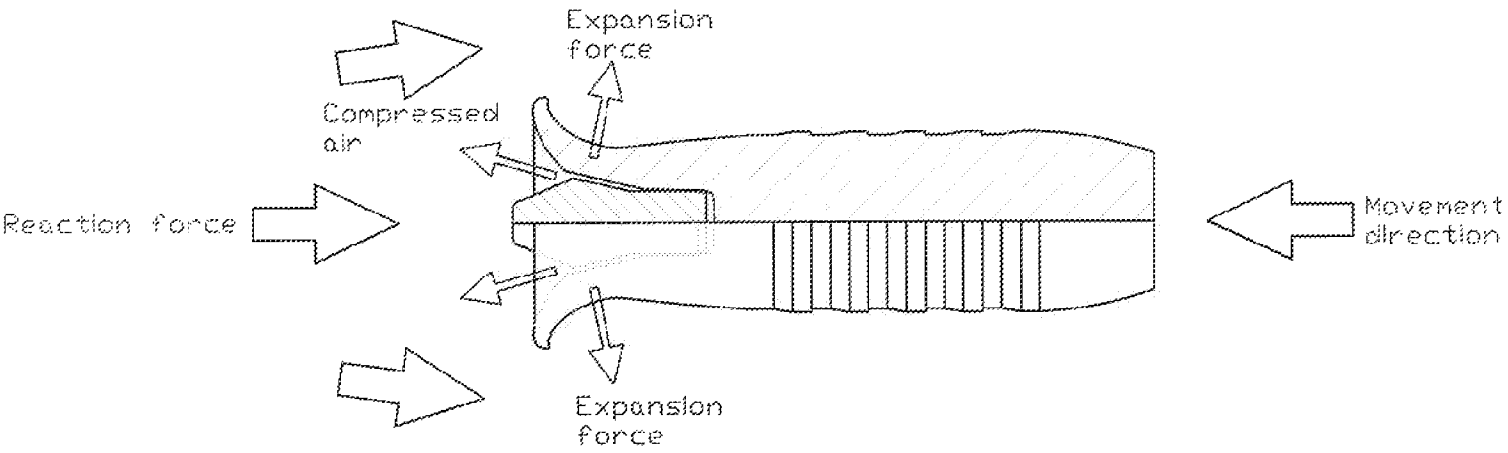
Figure 17:
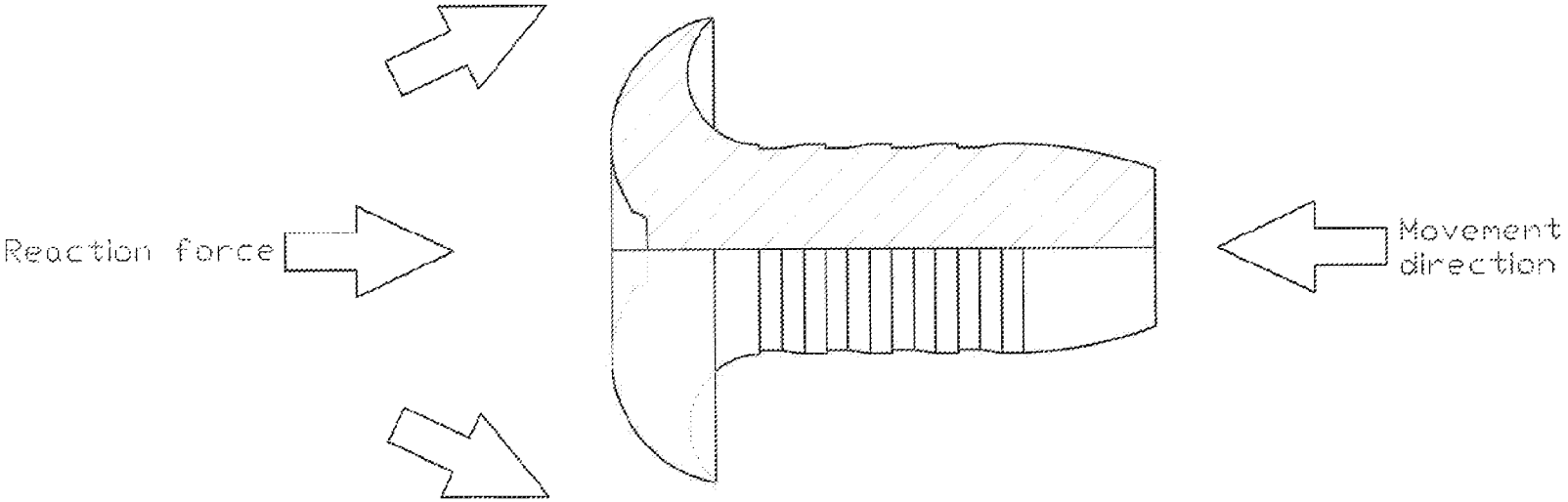

As shown in FIGS. 8 to 17, the combined mechanical forces and air compressed into and released from the cavities 31 and 32 as the plunger 18 is forced into the hollow 14 forces the wall of the hollow body 12 outward in a controlled, progressive and predictable rate. The escaping compressed air and resulting hydrostatic shock also lowers the friction and shearing forces of the bullet through tissue to increase weight retention while enlarging the wound channel and keeping its straight line rigidity towards its intended target.

Figure 18:
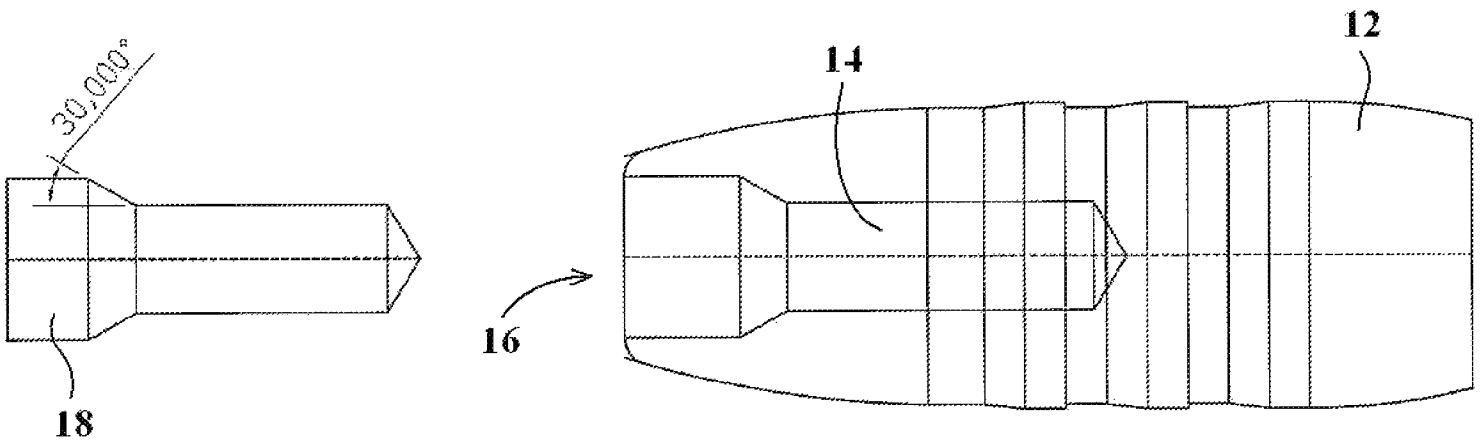
FIG. 18 shows a further embodiment of the invention, typically for light calibre bullets.

For ease of manufacturing, some embodiments may have a square cut rear end viewed from the side provided with a hollow, see FIGS. 13 to 18.

As shown in FIGS. 1 to 17, the examples also includes the use of five axially spaced cannelure bands 36, which extends radially past the bore diameter of the bullet 10 to engage the rifling of a rifle barrel to form a good seal. The cannelure grooves 38 between the bands also have the bore diameter of the bullet. The leading edge 40 of each cannelure band is angled at 11 degrees of the axis and the trailing edge 42 of the band is perpendicular to the axis.

It shall be understood that the examples are provided for illustrating the invention further and to assist a person skilled in the art with understanding the invention and are not meant to be construed as unduly limiting the reasonable scope of the invention.

The invention claimed is:

1. A bullet, which comprises:

a bullet-shaped body of a first metal composition, which body has a hollow cavity defined therein along the axis of the bullet with an opening at the point of the bullet shaped body;

a plunger of a second metal composition, which is harder than the first metal, and shaped generally complementary to the hollow cavity;

wherein the hollow cavity and the plunger have a generally complementary conical shape widening towards the point of the bullet;

wherein the inner surface of the hollow cavity is generally conical or cylindrical or combinations thereof and provided with one or more shoulder formations, which taper outward towards the opening at the point of the bullet;

wherein the plunger is dimensioned in such a way that when it is inserted into the hollow cavity, the plunger will not reach the far end of the hollow to define an empty cavity;

wherein each shoulder formation of the plunger does not reach its complementary bearing formation on the inside surface of the hollow to also define one or more further circular empty cavities; and wherein a number of successive cavities are defined of which the volume decreases towards the point of the bullet.

2. A bullet as claimed in claim 1, wherein multiple cavities are incorporated with the shoulder and bearing formation being at an angle of between 20 and 40 degrees of the axis.

3. A bullet as claimed in claim 1, wherein the plunger is shaped to protrude past the rim of the opening in the bullet body and continues and complete the shape of the bullet body into a typical spitzer type bullet point.

4. A bullet as claimed in claim 3, wherein one circular cavity is defined between the plunder and a first shoulder of the hollow and a second cavity at the end of the hollow is preferable.

5. A bullet as claimed in claim 4, wherein one cavity is defined at the end of the hollow with no cavity formed between the shoulder of the hollow and corresponding shoulder formation of the plunger, which is at an angle of between 10 and 20 degrees.

6. A bullet as claimed in claim 1, wherein the plunger is from a brass-alloy and the bullet body is of copper in a half-hard condition.

7. A bullet as claimed in claim 6, wherein the copper bullet body is annealed.

8. A bullet as claimed in claim 1, which comprises three or more cannelure bands axially spaced along the bearing surface of the bullet, which extends radially past the bore diameter of the bullet into the rifling groove diameter to engage the rifling of a rifle barrel.

9. A bullet as claimed in claim 8, wherein the leading edge of the cannelure band is angled at between 9 to 13 degrees of the axis and the trailing edge of the band is perpendicular to the axis or undercut.

* * * * *